United States Patent [19]

Gullichsen

[11] Patent Number: 5,047,118

[45] Date of Patent: Sep. 10, 1991

[54] METHOD FOR DECREASING ENERGY CONSUMPTION DURING REFINING OF FIBER MATERIAL AT A REDUCED GRINDING FREQUENCY WHILE MAINTAINING CAPACITY

[75] Inventor: Johan Gullichsen, Sjundea, Finland

[73] Assignee: Kamyr AB, Karlstad, Sweden

[21] Appl. No.: 70,212

[22] Filed: Jul. 6, 1987

Related U.S. Application Data

[63] Continuation-in-part of Ser. No. 8,667, Jan. 30, 1987, abandoned, and Ser. No. 37,005, Apr. 10, 1987, Pat. No. 4,754,935.

[51] Int. Cl.[5] ..... D21C 1/12

[52] U.S. Cl. ..... 162/23; 162/28; 241/28

[58] Field of Search ..... 162/23, 28; 241/244, 241/261.1, 28

[56] References Cited

U.S. PATENT DOCUMENTS

| | | | |
|---|---|---|---|
| 2,980,350 | 4/1961 | Lejuene | 241/73 |
| 3,305,183 | 2/1967 | Monden | 241/261.1 |
| 3,815,834 | 6/1974 | Gilbert | 241/28 |
| 4,401,280 | 8/1983 | Reinhall | 241/261.1 |
| 4,600,475 | 7/1986 | Reinhall et al. | 162/23 |

FOREIGN PATENT DOCUMENTS

| | | |
|---|---|---|
| 901857 | 6/1972 | Canada . |
| 1079559 | 6/1980 | Canada . |
| 8105217 | 9/1981 | Sweden . |

OTHER PUBLICATIONS

Rydholm, "Pulping Processes", Inerscience Publishing, N.Y., Sep. 1967, p. 326–331.

Salmen, N. L. and Fellers, C., "The Fundamentals of Energy Consumption During Viscoelastic and Plastic Deformation of Wood", Trans. Tech. Sec. (Can. Pulp Pap. Ass.) 9 (4):TR 93 (1982).

Salmen et al., "Fatigue of Wood-Characterization of Mechanical Defibration", J. Pulp Pa. Sci. 11 (3):J 68 (1985).

Atack, D., "Fundamental Differences in Energy Requirement . . . ", Sven Papperstidn. 84 (14):22 (1981).

Pearson, A. J., "Towards a Unified Theory of Mechanical Pulping . . . ", Paper presented at 1983 Mechanical Pulping Conf., Wash., D.C., Jun. 14–14, 1983.

Salmen, "Chip Refining: Influence of Mechanical and Chemical Treatments on the Energy Consumption . . . ", STFI-meddelande serie A Nr 964; Stockholm, 12/86.

*Primary Examiner*—Steve Alvo

*Attorney, Agent, or Firm*—Cushman, Darby & Cushman

[57] ABSTRACT

The energy consumption of a cellulosic fibrous material refiner is significantly reduced, while the capacity is maintained by reducing grinding frequency while increasing the retention time and power amplitude (edge bar load). The grinding frequency is maintained between about 200–2,000 Hz, preferably between about 300–900 Hz. The retention time is more than a second, being increased at least about 100 times compared to conventional disk refiners. The power amplitude is at least doubled. Retention time is increased by greatly increasing the retention volume by removing the majority (at least about 90% of the steam at approximately the area that it is generated, minimizing the number of cutting elements, and disposing the grinding surfaces of the refiner so that they define a volume of revolution (e.g. a frusto-conical or cylindrical volume).

17 Claims, 2 Drawing Sheets

FIG. 1
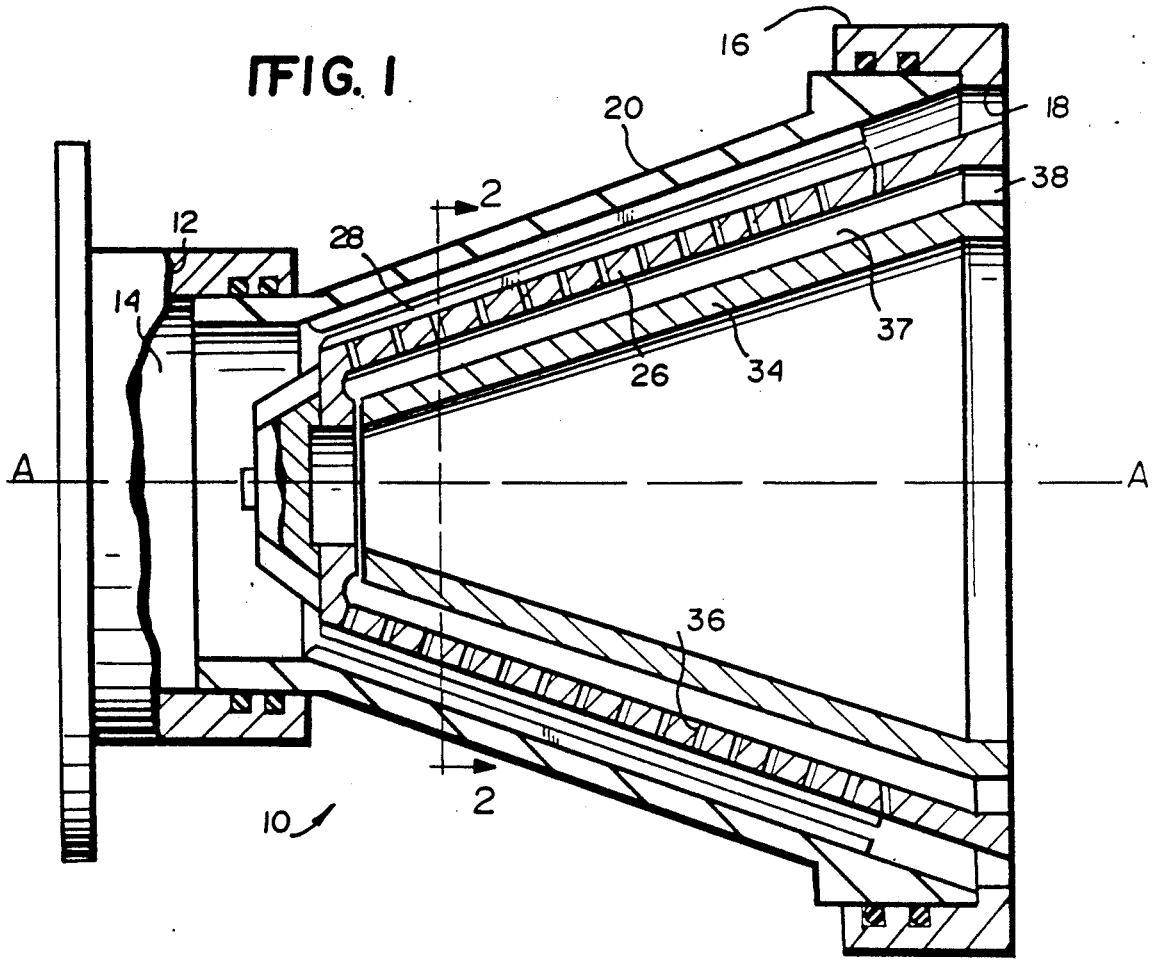
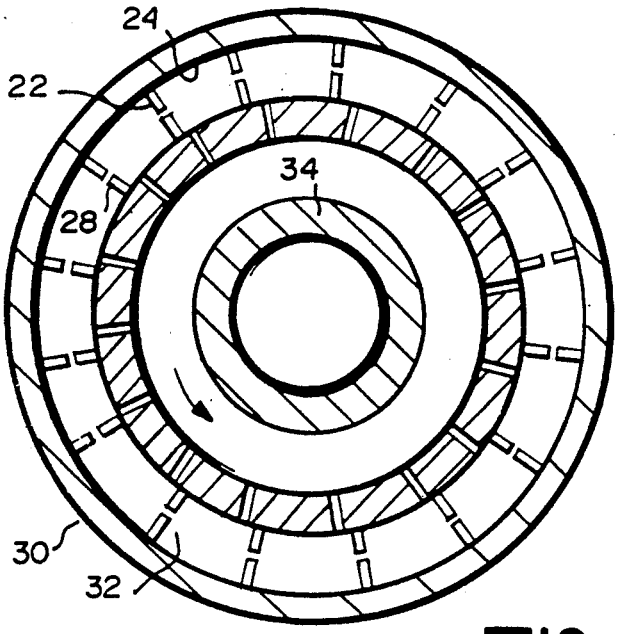
FIG. 2

FIG. 3
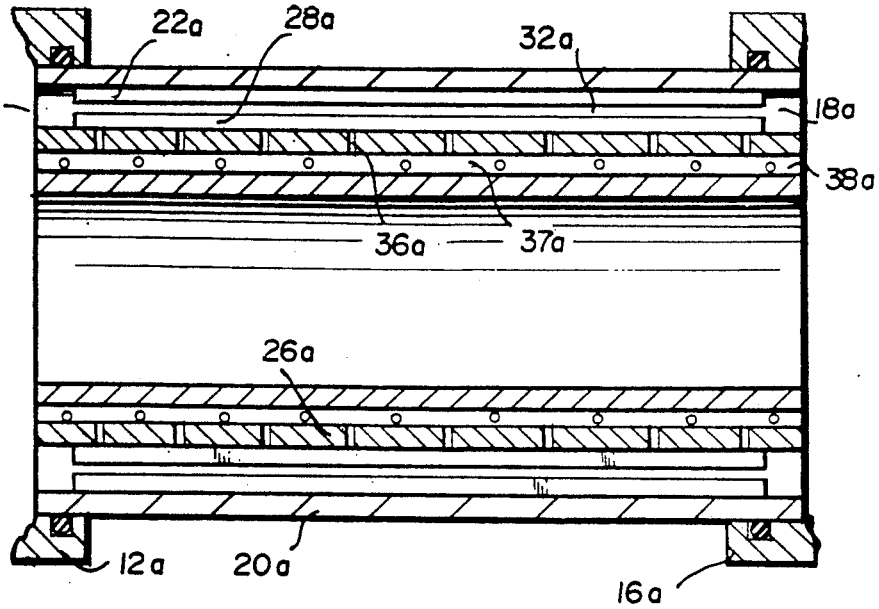
FIG. 4
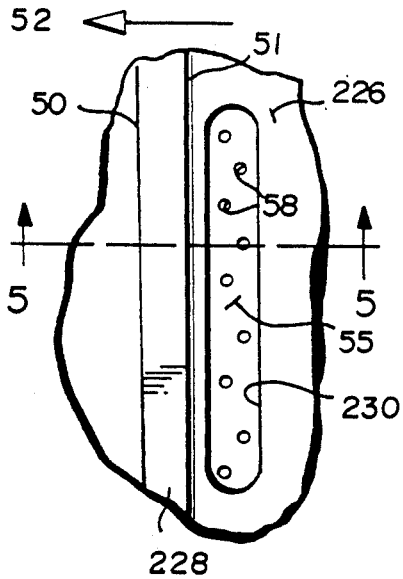
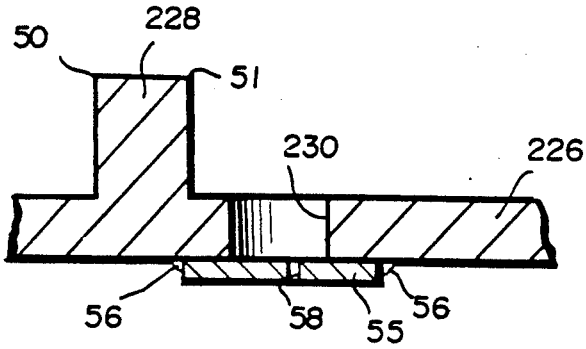
FIG. 5

METHOD FOR DECREASING ENERGY CONSUMPTION DURING REFINING OF FIBER MATERIAL AT A REDUCED GRINDING FREQUENCY WHILE MAINTAINING CAPACITY AT A REDUCED GRINDING FREQUENCY

CROSS REFERENCE TO RELATED APPLICATION

This application is a continuation-in-part of application Ser. No. 8,667 filed Jan. 30, 1987, now abandoned, and application Ser. No. 37,005 filed Apr. 10, 1987, now U.S. Pat. No. 4,754,935, the disclosures of which are hereby incorporated by reference herein.

BACKGROUND AND SUMMARY OF THE INVENTION

In the production mechanical paper pulps, it has long been recognized that a higher yield can be obtained from a given amount of raw cellulosic fibrous material compared to chemical pulping processes. Mechanical pulping refers to refiner mechanical pulping (RMP), thermomechanical pulping (TMP), chemimechanical pulping (CMP), and chemithermomechanical pulping (CTMP) and other methods of producing high-yield pulps. In mechanical pulping, the chips are broken down into progressively smaller chips or pulp using a refiner or the like. Typically, a refiner includes a relatively movable grinding surfaces defining a grinding zone therebetween wherein chips are reduced to form pulp. These grinding surfaces, for example oppositely disposed discs or conical surfaces, are relatively rotated by an electric motor. In areas where electrical costs are high, the cost of operating the refiner can be prohibitive. For example, approximately 1,000 kWh per ton of pulp may be used per refining stage with approximately 2,000 kWh per ton produced pulp for the conventional two-stage refiner.

It has been theorized that the power consumption of a refiner can be significantly reduced by reducing the grinding frequency of the refiner. It has been suggested that this be done by reducing the refiner speed. However when the refiner speed is reduced, so is the capacity of the refiner to produce pulp, and the reduced pulp production in almost every instance be considered unacceptable from the commercial standpoint.

According to the present invention, it is possible to significantly reduce energy consumption of the refiner while not significantly adversely affecting refiner capacity (pulp production). This is accomplished according to the present invention by significantly reducing the grinding frequency of the refiner, while at the same time significantly increasing retention time and power amplitude.

As used in the present specification and claims, "grinding frequency" means the number of relative revolutions per second (rps) of the grinding surfaces (the number of rotor revolutions/sec. where there is a rotor and a stator) multiplied by the number of grooves (cutting elements) at the pulp discharge end of the rotor grinding surface. In conventional commercial diskrefiners, the rotor is rotated at between about 1,000–1,800 rpm, with the cutting elements commonly numbering between about 400–600, so that a grinding frequency of at least about 6,000 Hz is provided, and the grinding frequency can be 30,000 Hz, or even more. According to the present invention, the grinding frequency is reduced by an order of magnitude or two. Typically, according to the present invention the number of cutting elements and the rpms of the grinding surfaces are provided so that a major portion of the power dissipation of the refiner takes place at a grinding frequency of between about 200–2,000 Hz, preferably between about 300–900 Hz (e.g. between about 300–800 Hz).

Pulp production is maintained according to the present invention, while power consumption is greatly reduced, by significantly increasing both the retention time and the power amplitude. The retention time is the average amount of time fibrous cellulosic material is within the grinding zone, and the power amplitude is the edge bar load.

According to the present invention, the retention time is increased by significantly increasing the retention volume. The retention volume is increased by removing the majority of the steam (e.g. at least about 90% of the steam) in generally the area that it is generated within the grinding zone. The steam takes up a significant amount of space in the grinding zone, and if removed then the retention volume is increased greatly. Retention volume is further increased because a minimum number of cutting elements are utilized, and the cutting elements themselves take up volume within the grinding zone. For example, the number of cutting elements can be limited to between about 12–67 (e.g. 20–60) compared to about 400–600 in conventional refiners. Still further, the retention volume can be increased by the configuration of the grinding zone. The grinding zone can be configured in the shape of a volume of revolution (a cone or cylinder) by disposing the grinding surfaces so that they are frusto-conical or cylindrical. Retention time according to the invention is at least about a second, and typically is on the order of greater than three seconds, and with 90% steam removal could typically be expected to be in the range of five-six seconds. This compares with a retention time of about five milliseconds in conventional disk refiners. Thus the retention time is at least about 100 times greater according to the invention than in conventional disk refiners.

Power amplitude is inherently increased according to the invention when the number of bars are minimized, and the grinding zone is defined so that it is "longer", increasing the effective length of the cutting elements. The power amplitude according to the invention could typically be at least double that of a conventional disk refiner, and can be expected to be on the order of about five times greater.

The cellulose pulp produced utilizing the methods according to the invention will have different properties than conventional mechanical pulps since the net affect of the new procedures according to the invention will be to cause structural changes to the fibrous material in different ways than they have typically occurred in conventional disk refiners.

The design of the refiner according to the present invention, having a minimum number of cutting elements (bars) results in much more area of the grinding elements being available for steam removal so that the steam can be removed in an effective manner to achieve the desired increase in retention time. According to the invention, also, this additional area for steam removal is effectively utilized, and the steam velocity is controlled, so as to remove the majority (e.g. at least about 90%) of the generated steam while minimizing the amount of fiber withdrawn with the steam.

According to one aspect of the present invention, there is provided a method of refining cellulosic fibrous material utilizing juxtaposed relatively movable grinding surfaces defining a grinding zone between them, with a material inlet to the grinding zone and a material outlet from the grinding zone, comprising the steps of: (a) Grinding the material between the grinding surfaces so that the majority (if not all) of power dissipation of the refiner takes place at a grinding frequency of about 200-2,000 Hz (preferably 300-900 Hz, e.g. 300-800). And (b) retaining the material within the grinding zone at a retention time of at least about one second (preferably greater than three seconds, e.g. on the order of about five-six seconds).

According to another aspect of the present invention there is provided a method of refining cellulosic fibrous material utilizing juxtaposed grinding surfaces movable relative to each other with an inlet and outlet for the fibrous material, comprising the steps of: Grinding material between the surfaces at a grinding frequency of about 200-2,000 Hz; and removing the majority (e.g. at least about 90%) of the steam generated between the material inlet and outlet, approximately at the area of steam generation. Preferably there is also provided the step of forming the grinding surfaces so that a grinding zone between the grinding surfaces defines a volume of revolution (e.g. cone or cylinder) about an axis with the inlet and outlet adjacent opposite ends of the volume of revolution.

The invention also contemplates a method of refining cellulosic fibrous material having juxtaposed grinding surfaces capable of relative rotation, with an inlet and an outlet for the fibrous material, comprising the steps of significantly reducing energy consumption during refining, while maintaining substantially the same capacity, compared to a conventional commercial disk refiner having cutting elements numbering between about 400-600 and a grinding frequency of at least about 6,000. The method steps are accomplished by significantly reducing refiner frequency while significantly increasing (e.g. increasing 100 times or more) the retention time, and significantly increasing (e.g. at least doubling) the power amplitude.

The new cellulose pulp produced according to the present invention is difficult to define in terms of properties, but is clearly distinct from conventional mechanical pulps. Cellulose pulp according to the invention is best defined as pulp produced by practicing the method steps set forth above.

According to still another aspect of the present invention, a refiner is provided with structure for optimum removal of steam generated in the grinding zone, the structure according to the invention taking advantage of the minimum number of cutting bars, and thus the relatively large area on the grinding surfaces between the cutting bars.

It is the primary object of the present invention to provide for a significant reduction in power consumption of a refiner producing mechanical pulp, while maintaining refiner capacity (pulp production). This and other objects of the invention will become clear from an inspection of the detailed description of the invention and from the appended claims.

BRIEF DESCRIPTION OF THE DRAWINGS

FIG. 1 is a schematic side view, partly in cross-section and partly in elevation, of a portion of a refiner utilizable for the practice of the method according to the present invention;

FIG. 2 is a cross-sectional view taken along lines 2—2 of FIG. 1;

FIG. 3 is a view similar to that of FIG. 1 illustrating a refiner having a cylindrical grinding zone, for the practice of the method of the present invention;

FIG. 4 is a top view of a portion of the rotating grinding surface of the refiner of FIG. 1, showing steam removal means associated therewith; and FIG. 5 is a cross-sectional view taken along lines 5—5 of FIG. 4.

DETAILED DESCRIPTION OF THE DRAWINGS

The details of an exemplary refiner for the practice of the method according to the present invention will be seen clearly in said co-pending application Ser. No. 37,005, filed Apr. 10, 1987, to which attention is directed. For ease of illustration the refiner illustrated in the drawings of the subject application is simplified.

FIGS. 1 and 2 illustrate a refiner indicated generally by reference numeral 10, constructed for the practice of a method according to the present invention. The refiner includes an outer housing 12 defining a fibrous material inlet 14 at one end of the refiner and an outer housing 16 at the opposite end defining a fibrous material annular outlet 18. Between axially aligned outer housings 12 and 16, there is provided an axially aligned frusto-conical stator 20 having a plurality of elongated grinding or cutting elements 22 projecting inwardly along its inner frusto-conical surface 24. A frusto-conically shaped rotor 26 is mounted in juxtaposition with stator 20 and has a plurality of elongated grinding or cutting elements (or bars) 28 spaced circumferentially thereabout one from the other along the outer frusto-conical surface 30 thereof. The number of elements 28 may vary from portion to portion of the surface 30, as may their configurations. Consequently, it will be appreciated that the frusto-conically shaped stator and rotor, 20 and 26, respectively, together with their cutting elements 22 and 28, define a grinding zone 32 constituting a volume of revolution, in this embodiment a frusto-conical volume of revolution, about the elongated axis A—A of refiner 10.

The rotor 26 is suitably mounted in conventional bearings, not shown, and driven, for example, by a conventional electric motor, also not shown. It will also be appreciated that while stator 20 is shown in a fixed position and rotor 26 rotates within stator 20, an opposite configuration may be provided with the rotatable rotor external to the fixed stator. Alternatively, both the grinding surfaces may be rotated, e.g. in opposite directions.

Disposed within the inner surface of rotor 26 and spaced therefrom is a frusto-conical housing 34 fixed and forming a part of the outer housing 16. A plurality of openings 36 are disposed through rotor 26 at longitudinally and circumferentially spaced positions thereabout for purposes of venting steam from the grinding zone 32 between stator 20 and rotor 26. A steam vent passage 37 is disposed between the fixed housing 34 and rotatable rotor 26 for venting the steam from the grinding zone 32 through a steam outlet 38.

In using the refiner illustrated in FIGS. 1 and 2 hereof, fibrous material (e.g. wood chips) is fed into inlet 14 and into the grinding zone 32, by conventional feeding means (not shown). The grinding action in the grinding zone 32 reduces the chips, and the fibrous material flows out the refiner through outlet 18. In contrast to conventional disc-type grinders for this purpose which are normally rotated at between 1,000–1,800 rpm with cutting elements commonly numbering 400 through 600, giving a grinding frequency of 6,000–20,000 Hz, or more, the present invention reduces energy consumption by decreasing the grinding frequency, while maintaining pulp production (e.g. maintaining the rotary speed at between about 1,000–1,800 rpm). To accomplish this, the number of cutting elements is substantially reduced (minimized), e.g. to approximately 12–67 (e.g. 20–60). Thus, the refiner is operated so that the vast majority, if not all, of the power dissipation of the refiner takes place at low grinding frequency, e.g. about 200–2,000 Hz (preferably about 300–800/900 Hz). With this reduction in grinding frequency, the energy consumption may be reduced significantly. A 50% reduction is conceivable.

It will be further appreciated that the volume and retention time of the fibrous material in the grinding zone is increased using a frusto-conical grinding zone as compared, for example, with a disc-type grinder of the prior art. Consequently, the length of the grinding zone can be increased while maintaining the diameter of the refiner within reasonable limits and on the order of the diameter of disc-type refining units.

Furthermore, the grinding action is considerably enhanced (and the retention volume significantly effectively increased) by the removal or discharge of the steam generated by the grinding action or as a result of any liquid added to the grinding zone which turns into steam. The wide spacing resulting from the minimum number of cutting elements (bars) 28 allows area for effective removal of the majority (e.g. at least about 90%) of the steam where generated. Thus the steam is discharged from the grinding zone substantially continuously along its length through the openings 36 for removal from the refiner by passage 37 and outlet 38. Removal of the steam decreases the compressibility of the chip-fiber-water-steam mixture.

The steam quantity is also regulated by keeping a suitable pressure difference between the steam outlet and the fiber material outlet.

In the embodiment of the invention illustrated in FIG. 3, like elements are referred to by like numerals, succeeded by the letter notation a. In this form, the stator housing **20*a* and rotor 26*a* are cylindrical in shape, defining a grinding zone 32*a* therebetween, constituting a volume of revolution about the axis A—A. As in the prior embodiment, cutting elements 22*a* and 28*a* are formed on the stator and rotor, respectively, for the full length of the grinding zone 32*a*. The rotor has steam outlet openings 36*a* spaced axially and circumferentially throughout its surface for directing steam from the grinding zone 32*a* into the passage 37*a* for discharge through outlet 38*a***.

The capacity of the refiner compared to conventional refiners is maintained, while power consumption is significantly reduced, by significantly increasing retention time and power amplitude (edge bar load). The retention time is increased by removal of steam, removal of metal (the number of bars are minimized, which bars take up volume), and providing a larger area by increasing the length of the grinding zone by providing it as a volume of revolution (e.g. cone). Typically the retention time would be measured in seconds, as opposed to milliseconds in conventional disk refiners, the retention time according to the invention being at least about one second, preferably greater than three seconds, and can be expected to be in the range of about five-six seconds. The power amplitude is inherently increased by minimizing the number of bars and by lengthening the bars (by providing a conical grinding zone, for example). The power amplitude would typically be at least doubled compared to conventional disk refiners, and could be expected to be on the order of about five times greater.

An effective manner of steam removal to achieve the objectives according to the invention may be seen from an inspection of FIGS. 4 and 5. In this embodiment, a rotor 226 has a plurality of cutting bars 228 having leading and trailing edges 50, 51, respectively in the direction of rotation 52. Adjacent the trailing edges 51 of the bars 228 are provided elongated slots 230. The slots typically would be more than an inch long and have substantial width. Disposed in operative association with each slot 230, on the opposite side of the rotor 226 from the bars 228, is a screen plate 55 which may be attached by welds 56 or the like to the rotor 226, each screen plate 55 having a plurality of holes 58 formed therein, the holes 58 each being of significantly less dimension than the slot 230. Such a construction takes advantage of the large available area between bars 228 on the rotor 226, and the structure illustrated in FIGS. 4 and 5 controls the steam velocity. The velocity of the steam flowing through the slots 230 is relatively small, meaning that a relatively small amount of fiber will be entrained therewith. However because of the large size of the slots 230, the volume of steam flowing will be great. The holes 58 are small so that any fiber entrained in the steam will have a tendency to be prevented from flowing therethrough, and the steam velocity will increase flowing through the holes 58 so that they will have a tendency to be kept unclogged, and then the velocity will again be reduced after passing through the openings 58 into a large interior volume of the rotor (as in steam vent passage 37). Preferably a two stage separation of fibers and steam takes place as in said co-pending application Ser. No. 37,005, filed Apr. 10, 1987.

Theoretical calculations verify the ability to achieve the desired results according to the invention. The following calculations are based on a comparison of a 1000 mm diameter disc refiner with a low frequency refiner having a maximum diameter of 1000 mm with a minimum diameter of 400 mm and a total rotor length of 850 mm. The comparison is as follows:

TABLE I

| | Standard Disc Refiner | Low Frequency Refiner |
|---|---|---|
| Wood Temp. of feed °C. | 20 | 20 |
| Water content of feed t/t | 2–3 | 2–3 |
| Energy input kWh/bdt (assumed) | 1000 | 500 |
| Steam release $m^3$/bdt | 600–475 | 155–30 |
| Active volume in refiner (200 tbdp/d)liter | 6 | 38 |
| Average retention time (no steam separated) milliseconds | 4.4–5.5 | 106–53 |
| Average retention time (all steam separated) Seconds | not feasible | 6–7 |

TABLE I-continued

| | Standard Disc Refiner | Low Frequency Refiner |
|---|---|---|
| Relative retention time Low Frequency/ Standard Disc | 1 | 1600–1100 |

Power amplitude can also be calculated to compare the power amplitude of a standard commercial disk refiner and one according to the invention. Applying the "edge bar" theory, and assuming 400 bars each 333 millimeters long for a conventional disk refiner, and 12 bars 425 millimeters long and another 12 twice that long, in a refiner according to the invention, the relative power amplitudes will be as follows:

$$B = \frac{8000 \text{ kW (assumed)}}{25 \text{ rps} * 400 * 333 \text{ mm}} = 0.002 \text{ kWs/mm};$$

$$B = \frac{4000 \text{ kW (assumed)}}{25 \text{ rps} * (12 + 24) * 425 \text{ mm}} = 0.010 \text{ kWs/mm}.$$

Thus it will be seen that according to the invention the retention time is increased compared to a conventional disk refiner even if there is no steam separation, and is on the order of seconds as compared to milliseconds if there is complete steam separation (with 90% steam separation a retention time of about five-six seconds could be expected in the practice of the invention), and the relative retention time is more than 1,000 times greater according to the invention than in a conventional disk refiner. Further the power amplitude is on the order of five times greater.

It will thus be seen that according to the present invention, there is provided a method for reducing the energy consumption of a refiner or defibrator of pulp material, while maintaining refiner production. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent pulps, and structures.

What is claimed is:

1. A method of refining cellulosic fibrous material utilizing juxtaposed relatively movable grinding surfaces defining a grinding zone between them, with a material inlet to the grinding zone and a material outlet from the grinding zone, comprising the steps of:

(a) grinding the material between the grinding surfaces so that the majority of power dissipation of the refiner takes place at a grinding frequency of about 200–2,000 Hz, and (b) retaining the material within the grinding zone a retention time of at least about one second.

2. A method as recited in claim 1 wherein step (a) is practiced so that the grinding frequency is between about 300–900 Hz.

3. A method as recited in claim 2 wherein step (a) is practiced so that the grinding frequency is between about 300–800 Hz.

4. A method as recited in claim 2 wherein step (b) is practiced so that the retention time is greater than three seconds.

5. A method as recited in claim 1 wherein step (b) is practiced by removing the majority of the steam generated in the refiner, between the material inlet and outlet, at about the area of steam generation.

6. A method as recited in claim 5 wherein step (b) is practiced by removing at least about 90 percent of the steam generated in the refiner, between the material inlet and outlet, at about the area of steam generation.

7. A method as recited in claim 5 wherein step (b) is practiced by disposing the grinding surfaces so that the grinding zone therebetween defines a volume of revolution about an axis with the material inlet and outlet adjacent opposite ends of the volume of revolution.

8. A method as recited in claim 7 wherein step (b) is further practiced by defining a frusto-conical volume of revolution.

9. A method as recited in claim 7 wherein step (b) is further practiced by providing about 20–60 total cutting elements on both grinding surfaces.

10. A method as recited in claim 1 wherein one of the grinding surfaces is a stator and the other is a rotor, and wherein about 12–67 cutting elements are provided on the rotor.

11. A method as recited in claim 9 wherein step (a) is practiced so that the grinding frequency is between about 300–900 Hz.

12. A method as recited in claim 1 wherein one grinding surface is rotated relative to the other at about 1,000–1,800 rpm.

13. A method as recited in claim 2 wherein one grinding surface is rotated relative to the other at about 1,000–1,800 rpm.

14. A method as recited in claim 3 wherein one grinding surface is rotated relative to the other at about 1,000–1,500 rpm.

15. A method as recited in claim 2 wherein step (b) is practiced by removing the majority of the steam generated in the refiner, between the material inlet and outlet, at about the area of steam generation.

16. A method as recited in claim 1 wherein steps (a) and (b) are practiced by providing about 20–60 total cutting elements on both grinding surfaces, and rotating the grinding surfaces with respect to each other at about 1,000–1,800 rpm so that compared to a commercial disk refiner having cutting elements numbering between about 400–600 and a grinding frequency of about 6,000 Hz or greater, energy consumption is significantly reduced while the capacity of the refiner is maintained substantially the same.

17. A method as recited in claim 16 wherein the reduction in energy consumption is on the order of about 50%.

* * * * *